US009358603B2

(12) United States Patent
Shiozawa et al.

(10) Patent No.: US 9,358,603 B2
(45) Date of Patent: Jun. 7, 2016

(54) FEEDING APPARATUS FOR METAL STRIPS AND MANUFACTURING APPARATUS FOR HEAT EXCHANGER FINS

(75) Inventors: Michihiro Shiozawa, Tokyo (JP); Hisayoshi Kido, Tokyo (JP); Takaharu Shimizu, Tokyo (JP)

(73) Assignee: HIDAKA SEIKI KABUSHIKI KAISHA, Tokyo (JP)

( * ) Notice: Subject to any disclaimer, the term of this patent is extended or adjusted under 35 U.S.C. 154(b) by 1040 days.

(21) Appl. No.: 13/504,073

(22) PCT Filed: Nov. 6, 2009

(86) PCT No.: PCT/JP2009/068985

§ 371 (c)(1),
(2), (4) Date: Apr. 25, 2012

(87) PCT Pub. No.: WO2011/055448

PCT Pub. Date: May 12, 2011

(65) Prior Publication Data

US 2012/0216664 A1 Aug. 30, 2012

(51) Int. Cl.

| | |
|---|---|
| ***B21D 43/11*** | (2006.01) |
| ***B21D 43/02*** | (2006.01) |
| ***B21D 43/28*** | (2006.01) |
| ***B21D 53/04*** | (2006.01) |
| ***B21D 53/08*** | (2006.01) |

(52) U.S. Cl.

CPC ..... *B21D 43/11* (2013.01); *B21D 53/04* (2013.01); *B21D 53/08* (2013.01); *B21D 43/027* (2013.01); *Y10T 83/658* (2015.04); *Y10T 83/6582* (2015.04)

(58) Field of Classification Search

CPC .... B21D 43/026; B21D 43/027; B21D 43/11; B21D 43/28; B21D 43/287; B21D 43/04; B21D 43/02; B21D 43/021; B21D 43/023; B21D 53/04; B21D 53/08; Y10T 83/6582; Y10T 83/4443; Y10T 83/4516; Y10T 83/4582; Y10T 83/6668; Y10T 83/494; Y10T 83/50; Y10T 83/658

USPC ..... 72/421, 419; 414/14, 16, 20

See application file for complete search history.

(56) References Cited

U.S. PATENT DOCUMENTS 2,039,699 A * 5/1936 Biazzi ..... B21D 43/287 101/44
3,874,216 A * 4/1975 Ames ..... 72/417

(Continued)

FOREIGN PATENT DOCUMENTS

JP 1-166823 A 6/1989
JP 5-237718 A 9/1993

(Continued)

*Primary Examiner* — Stephen Choi
*Assistant Examiner* — Evan MacFarlane
(74) *Attorney, Agent, or Firm* — Birch, Stewart, Kolasch & Birch, LLP

(57) ABSTRACT

A feeding apparatus for a wide metal strip, wherein a plurality of through-holes are formed with predetermined gaps in a length direction and a width direction, into a cutter and pulls narrow metal strips formed by cutting the wide metal strip between the through-holes in the length direction so that through-holes are formed along only the length direction. The feeding apparatus includes a feeding-in apparatus that is provided on an entrance side of the cutter that feeds the wide metal strip into the cutter and a pulling-out apparatus that is provided on an exit side of the cutter that pulls out the narrow metal strips, which have been cut out by the cutter. A linking member drives the feeding-in apparatus and the pulling-out apparatus in concert so that the wide metal strip is fed into the cutter together with the narrow metal strips out being pulled out from the cutter.

6 Claims, 11 Drawing Sheets

(56) References Cited

U.S. PATENT DOCUMENTS

| | | | | | |
|---|---|---|---|---|---|
| 5,349,841 | A * | 9/1994 | Honma | B21D 43/12 | 226/75 |
| 5,440,799 | A * | 8/1995 | Marshall | H01R 43/0488 | 29/566.2 |
| 6,145,424 | A * | 11/2000 | Matsuda et al. | 83/227 | |
| 2005/0020423 | A1 * | 1/2005 | Von Allwoerden | 493/81 | |

FOREIGN PATENT DOCUMENTS

| | | | |
|---|---|---|---|
| JP | 6-170637 | A | 6/1994 |
| JP | 2517029 | B2 | 7/1996 |
| JP | 10-076417 | A | 3/1998 |
| JP | 11-192600 | * | 7/1999 |
| JP | 11-192600 | A | 7/1999 |
| JP | 2006-21876 | A | 1/2006 |

* cited by examiner

FEEDING APPARATUS FOR METAL STRIPS AND MANUFACTURING APPARATUS FOR HEAT EXCHANGER FINS

TECHNICAL FIELD

The present invention relates to a feeding apparatus for metal strips and a manufacturing apparatus for heat exchanger fins.

BACKGROUND ART

As depicted in FIG. 8, a heat exchanger fin used in a heat exchanger such as a room air conditioner has a plurality of collar-equipped through-holes 104 formed in a length direction of a thin metal plate 102 made of aluminum or the like. As depicted in the enlargement, a collar-equipped through-hole 104 of the heat exchanger fin 100 has a brimmed collar 108 of a predetermined height formed around a through-hole 106 formed in the thin metal plate 102. Such collar-equipped through-holes 104 enlarge the heat-transfer area for the heat exchanger pipes fitted into the through-holes 104 and are therefore capable of improving the heat exchanging efficiency of the heat exchanger.

In addition, in the heat exchanger fin 100 depicted in FIG. 8, to improve the heat exchanging efficiency, louvers or slits (referred to hereinafter simply as the "louvers 112") are formed between the collar-equipped through-holes 104. As depicted in the enlargement, the louvers 112 are formed by bending the metal strip that has been cut into narrow widths in the up-down direction. Also, corner cut portions 110 that are cutaway portions are formed at a plurality of locations on the heat exchanger fin 100 to prevent contact between the heat exchanger fin 100 and other components provided near the installed location of the heat exchanger.

The heat exchanger fin 100 depicted in FIG. 8 is normally produced by having a plurality of heat exchanger fins simultaneously molded in parallel from a wide metal strip 120 depicted in FIG. 9.

The wide metal strip 120 first undergoes a burring process B that forms small holes to be used for the collar-equipped through-holes 104 through punch machining (burring) and the wide metal strip 120 in which the small holes have been formed is then subjected to an ironing process A that draws the peripheries of the punched out small holes to increase the diameters of the through-holes 106 while raising the heights of the collars 108 and a reflare process F that forms brim portions by bending the front ends of the collars 108. A louver machining process L that forms the louvers 112 is also carried out.

In this way, a plurality of collar-equipped through-hole rows, each of which is composed of a plurality of the louvers 112 and the collar-equipped through-holes 104 formed in the length direction of the wide metal strip 120, are formed in the width direction of the wide metal strip 120.

Next, after a punching process N in which the corner cut portions 110 formed in the side surfaces of the wide metal strip 120 and the punched-out portions 114 located between the collar-equipped through-hole rows are punched out, the wide metal strip 120 is cut by a cutter process S into separate collar-equipped through-hole rows to produce narrow metal strips 123. Next, the narrow metal strips 123 are cut into short strips by a cutting out process C to produce heat exchanger fins 100 like that depicted in FIG. 8.

The various processes that produce the heat exchanger fin 100 depicted in FIG. 8 are carried out by the manufacturing apparatus depicted in FIG. 10 (see for example Japanese Laid-Open Patent Publication No. H11-192600).

In the manufacturing apparatus depicted in FIG. 10, the wide metal strip 120 is wound in a coil in an uncoiler 202 and is pulled out via pinch rollers 204. Machining oil is applied by an oil applying apparatus 206 onto the wide metal strip 120 that has been pulled out and then the wide metal strip 120 is supplied to a mold 208 provided inside a press apparatus 200. Inside the mold 208, the collar-equipped through-holes 104, the louvers 112, the corner cut portions 110, and the punched-out portions 114 are formed in the wide metal strip 120.

In this way, the wide metal strip 120 in which the collar-equipped through-holes 104, the louvers 112, the corner cut portions 110, and the punched-out portions 114 have been formed is supplied to a cutter 210 and cut in the length direction to produce the narrow metal strips 123 before such narrow metal strips 123 are cut into short strips. The heat exchanger fins 100 depicted in FIG. 8 produced by such cutting into short strips are stored in a stacker 211.

DISCLOSURE OF THE INVENTION

The heat exchanger fins 100 depicted in FIG. 8 are continuously manufactured by the manufacturing apparatus depicted in FIG. 10. A plan view of a lower mold 208*a* of the mold 208 used in the press apparatus 200 of the manufacturing apparatus depicted in FIG. 10 is depicted in FIG. 11. The lower mold 208*a* depicted in FIG. 11 is fixed and an upper mold (not illustrated) is provided so as to be capable of moving toward and away from the lower mold 208*a* in the up-down direction.

The wide metal strip 120 is supplied to the lower mold 208*a* from the direction of the arrow X. Formation stages for forming the collar-equipped through-holes 104, the louvers 112, the corner cut portions 110, and the punched-out portions 114 in the wide metal strip 120 are successively disposed in a region 209 on the supply entrance side for the wide metal strip 120. The cutter 210 that cuts the wide metal strip 120 in the length direction to produce the narrow metal strips 123 is provided on the exit side of the lower mold 208*a*.

A feeding apparatus 212 is provided on the exit side of the cutter 210 of the lower mold 208*a* depicted in FIG. 11, which pulls the individual narrow metal strips 123 cut out by the cutter 210 out from the cutter 210 and also feeds the wide metal strip 120 into the cutter 210.

However, in recent years, due to demands for miniaturization of heat exchangers, there has been an increase in the number of corner cut portions 110 formed in the heat exchanger fin 100 depicted in FIG. 8.

There is also demand to operate the press apparatus 200 at high speed and increase the production of the heat exchanger fins 100.

On the other hand, if the press apparatus 200 is operated at high-speed (high speed rotation) to increase production of the heat exchanger fins 100 and the wide metal strip 120 is fed into the cutter 210 and the narrow metal strips 123 are pulled out from the cutter 210 by a feeding apparatus 212 provided on the exit side of the cutter, it has been established that there is a tendency for tearing, kinking, stretching, and the like to occur at the parts of the narrow metal strips 123 where the corner cut portions 110 are formed. This is believed to be due to an excessive load being applied if the force that also feeds the wide metal strip 120 into the cutter 210 is applied to the narrow metal strips 123.

Although it is possible to prevent kinking and the like of the narrow metal strips 123 by reducing the speed at which the narrow metal strips 123 are pulled out from the cutter 210

(i.e., by reducing the operating speed of the press apparatus 200), this lowers the rate at which the heat exchanger fins 100 can be produced.

Also, even when manufacturing heat exchanger fins in which the corner cut portions 110 are not formed as in FIG. 8, wide metal strips 120 with a much reduced thickness in keeping with demands in recent years for reductions in the weight and the like of heat exchangers are still coming into use. In this way, when a wide metal strip 120 that has a reduced thickness is used, the strength of the narrow metal strips 123 cut out by the cutter 210 is reduced, so that if the press apparatus 200 is operated at high speed (high-speed rotation), an excessive force will be applied to the narrow metal strips 123, resulting in the risk of tearing, kinking, stretching, and the like.

For this reason, the present invention aims to provide a feeding apparatus for metal strips and a manufacturing apparatus for heat exchanger fins that (i) solve the problem of an existing feeding apparatus for metal strips and manufacturing apparatus for heat exchanger fins in that kinking and the like of the narrow metal strips tend to occur when a wide metal strip in which a plurality of through-holes are formed in a length direction and a width direction with predetermined gaps is fed into a cutter and narrow metal strips, which have the through-holes formed in only the length direction and are produced by cutting the wide metal strip in the length direction between the through-holes, are pulled out from the cutter, and (ii) are capable of preventing kinking and the like of the narrow metal strips when the wide metal strip is fed into the cutter and also when the narrow metal strips are pulled out from the cutter.

As a result of investigating the problem described above, the present inventors discovered that by providing, at an entrance side of the cutter, a feeding-in apparatus that feeds the wide metal strip in which the through-holes are formed into the cutter, providing, at the exit side of the cutter, a pulling out apparatus that pulls out the individual narrow metal strips cut out by the cutter from the cutter, and operating the feeding-in apparatus and the pulling-out apparatus in concert, it is possible to prevent kinking and the like of the narrow metal strips when pulling the narrow metal strips out from the cutter.

That is, as a means of solving the problem described above, one aspect of the present invention is a feeding apparatus for metal strips that feeds a wide metal strip, in which a plurality of through-holes are formed with predetermined gaps in a length direction and a width direction, into a cutter and pulls narrow metal strips, which are formed by cutting the wide metal strip between the through-holes in the length direction so that through-holes are formed along only the length direction of the narrow metal strips, out of the cutter, the feeding apparatus including: a feeding-in apparatus that is provided on an entrance side of the cutter and feeds the wide metal strip into the cutter; and a pulling-out apparatus that is provided on an exit side of the cutter and pulls out the narrow metal strips, which have been cut out by the cutter, from the cutter, wherein a linking member that drives the feeding-in apparatus and the pulling-out apparatus in concert so that the wide metal strip is fed into the cutter together with the narrow metal strips being pulled out from the cutter is provided.

As another means of solving the problem described above, another aspect of the present invention is a manufacturing apparatus for heat exchanger fins including the feeding apparatus for metal strips described above.

As means of solving the problem described above, the present inventors have also proposed the following preferred aspects.

The feeding-in apparatus may include: a first reciprocating body provided so as to be capable of moving reciprocally with respect to the cutter; and first pins provided on the first reciprocating body and capable of moving up and down so that front end portions thereof are inserted into and withdrawn from through-holes of the wide metal strip, the front end portions being inserted into the through-holes of the wide metal strip when the wide metal strip is fed into the cutter, the pulling-out apparatus may include: a second reciprocating body provided so as to be capable of moving reciprocally with respect to the cutter; and second pins provided on the second reciprocating body and capable of moving up and down so that front end portions thereof are capable of being inserted into and withdrawn from through-holes of the narrow metal strips, the front end portions being inserted into the through-holes of the narrow metal strips when the narrow metal strips are pulled out of the cutter, and the feeding apparatus may further include: a driving apparatus that drives the first reciprocating body and the second reciprocating body in a predetermined direction; and the linking member that causes the first reciprocating body and the second reciprocating body to move in concert so that the wide metal strip is fed into the cutter together with the narrow metal strips being pulled out from the cutter.

By providing, as the linking member, a coupling member that couples the first reciprocating body and the second reciprocating body and an adjusting unit that adjusts the length of the coupling member, it is possible to adjust the gap between the first reciprocating body and the second reciprocating body and prevent the force applied to the narrow metal strips from becoming excessive.

Also, by providing the feeding-in apparatus with a first stopper operable when the first pins move in an opposite direction to a feeding direction of the wide metal strip, to become inserted into a through-hole of the wide metal strip to prevent movement in the opposite direction to the feeding direction of the wide metal strip and also operable when the first pins move in the feeding direction of the wide metal strip, to become withdrawn from the through-hole of the wide metal strip to enable the wide metal strip to move in the feeding direction, it is possible to reliably feed the wide metal strip into the cutter.

In addition, by providing the pulling-out apparatus with a second stopper operable when the second pins move in an opposite direction to a feeding direction of the narrow metal strips, to become inserted into through-holes of the narrow metal strip so as to prevent movement in the opposite direction to the feeding direction of the narrow metal strips and also operable, when the second pins move in the feeding direction of the narrow metal strip, to become withdrawn from the through-holes of the narrow metal strips so as to enable the narrow metal strips to move in the feeding direction, it is possible to reliably pull the narrow metal strips out of the cutter.

By providing the cutter, the feeding-in apparatus, the pulling-out apparatus, and the linking member inside a mold that forms the through-holes in the wide metal strip, it is possible to install a mold incorporating the feeding apparatus for metal strips in a press apparatus.

Here, by using a wide metal strip that has punched-out portions formed between the through-holes as the wide metal strip and forming narrow metal strips in which corner cut portions, where side edges are cut away, are formed, it is possible to effectively prevent tearing, kinking, or stretching of the corner cut portions when the narrow metal strips are pulled out from the cutter.

In addition, by chamfering corner portions of the punched-out portions and corner cut portions into arc shapes, it is possible to prevent tearing, kinking, or stretching of the corner cut portions when the narrow metal strips are pulled out from the cutter significantly more effectively.

According to the feeding apparatus for metal strips proposed by the present inventors, a wide metal strip is fed into the cutter by a feeding-in apparatus provided on the entrance side of the cutter. Even if a feeding-in force that feeds the wide metal strip into the cutter is applied to the wide metal strip that has not been cut into narrow metal strips by the cutter, the wide metal strip has sufficient durability. This means that it is possible to feed the wide metal strip into the cutter without kinking or the like.

In addition, a pulling-out apparatus that pulls the narrow metal strips, which are obtained by cutting the wide metal strip using the cutter, out of the cutter is provided on the exit side of the cutter. For this pulling-out apparatus, it is sufficient to apply a pulling force that pulls the narrow metal strips out from the cutter to the narrow metal strips, and it is not necessary to apply a force to feed the wide metal strip into the cutter. This means that it is possible to prevent tearing, kinking, or stretching that are caused by an excessive pulling force being applied to the narrow metal strips.

In addition, the feeding-in apparatus and pulling-out apparatus are driven in concert by a linking member so that the feeding-in operation that feeds the wide metal strip into the cutter and the pulling-out operation that pulls the narrow metal strips out from the cutter are linked. This means that it is possible to smoothly feed the wide metal strip into the cutter and to smoothly pull the narrow metal strips out from the cutter.

Therefore, according to the feeding apparatus for metal strips proposed by the present inventors, it is possible to prevent kinking and the like of the narrow metal strips even if the narrow metal strips are pulled out from the cutter at high speed. As a result, according to a press apparatus equipped with the feeding apparatus for metal strips proposed by the present inventors, it is possible for the press apparatus to operate at high speed.

Also, according to a manufacturing apparatus for heat exchanger fins equipped with the feeding apparatus for metal strips proposed by the present inventors, it is possible to increase the production of heat exchanger fins.

BEST MODE FOR CARRYING OUT THE INVENTION

Figure 1:
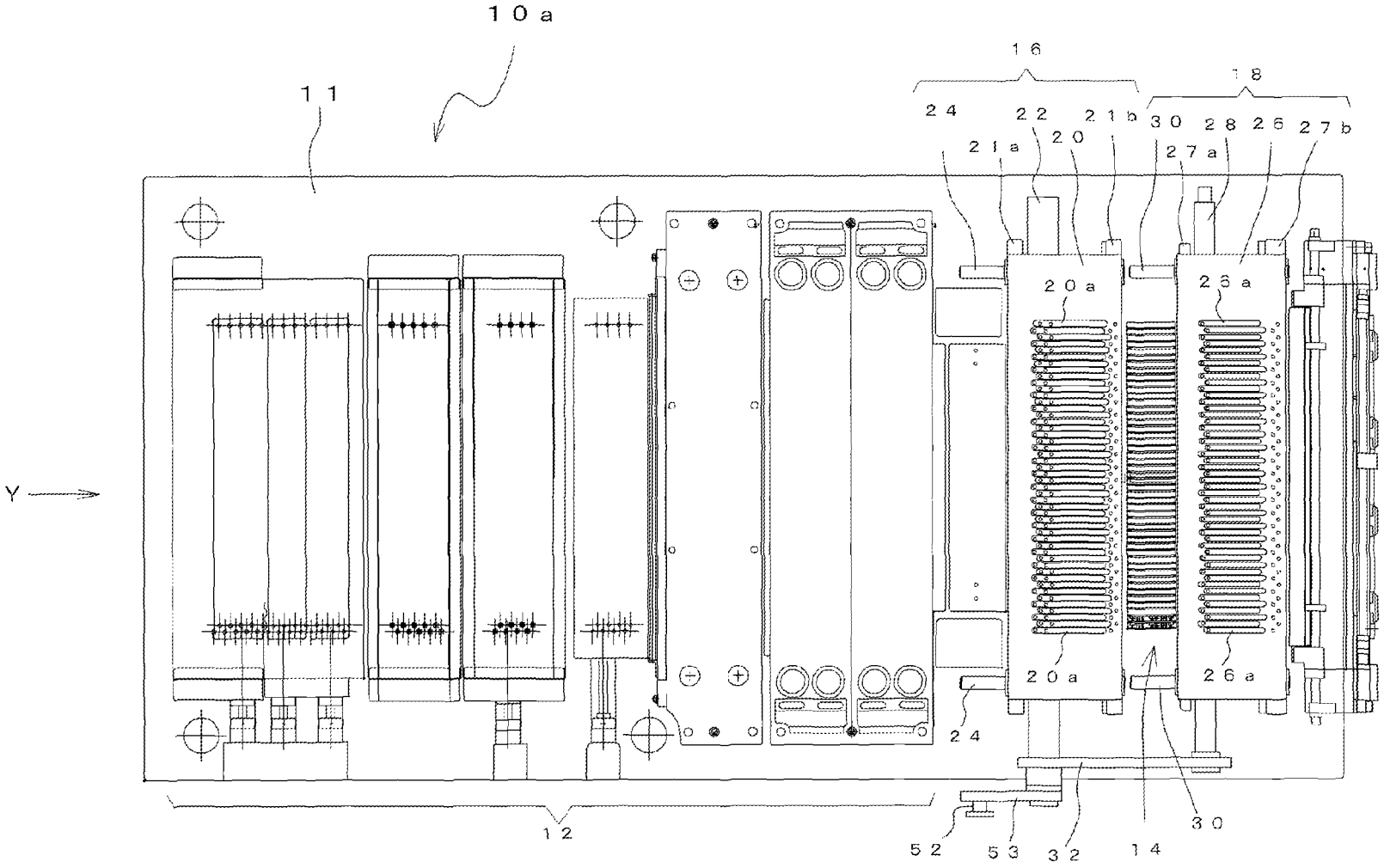
FIG. 1 is a plan view of a lower mold provided in a feeding apparatus for metal strips proposed by the present inventors.
Figure 8:
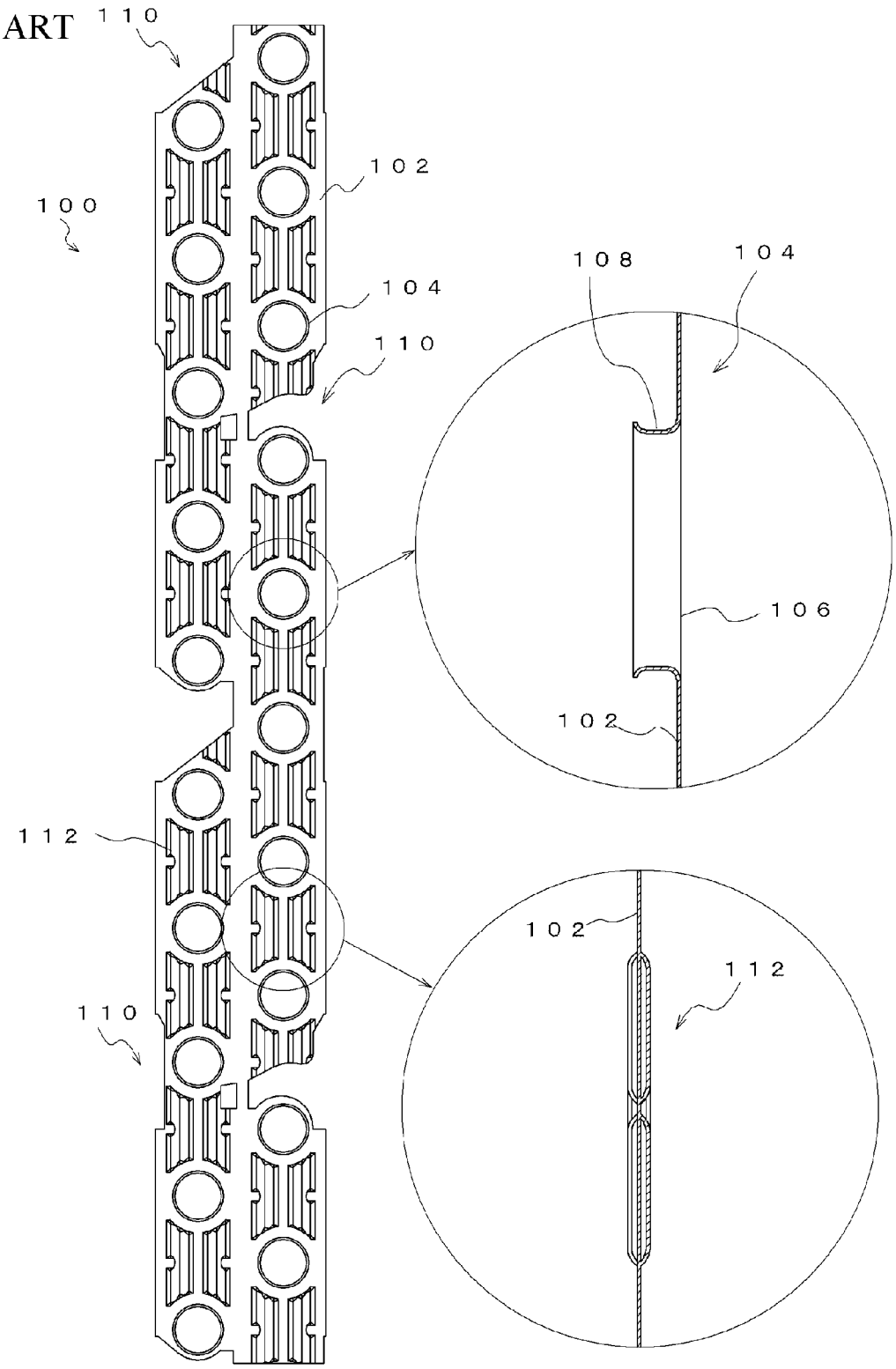
FIG.8 PRIOR ART
FIG. 8 is a front view useful in describing one example of a heat exchanger fin.

A feeding apparatus for metal strips proposed by the present inventors is incorporated into a mold of the press apparatus 200 (see FIG. 10) that manufactures the heat exchanger fin 100 depicted in FIG. 8. A plan view of a lower mold of this mold is depicted in FIG. 1. The lower mold 10*a* depicted in FIG. 1 is fixed and an upper mold (not illustrated) that is drivable is provided so as to be capable of moving toward and away from the lower mold 10*a*.

Figure 9:
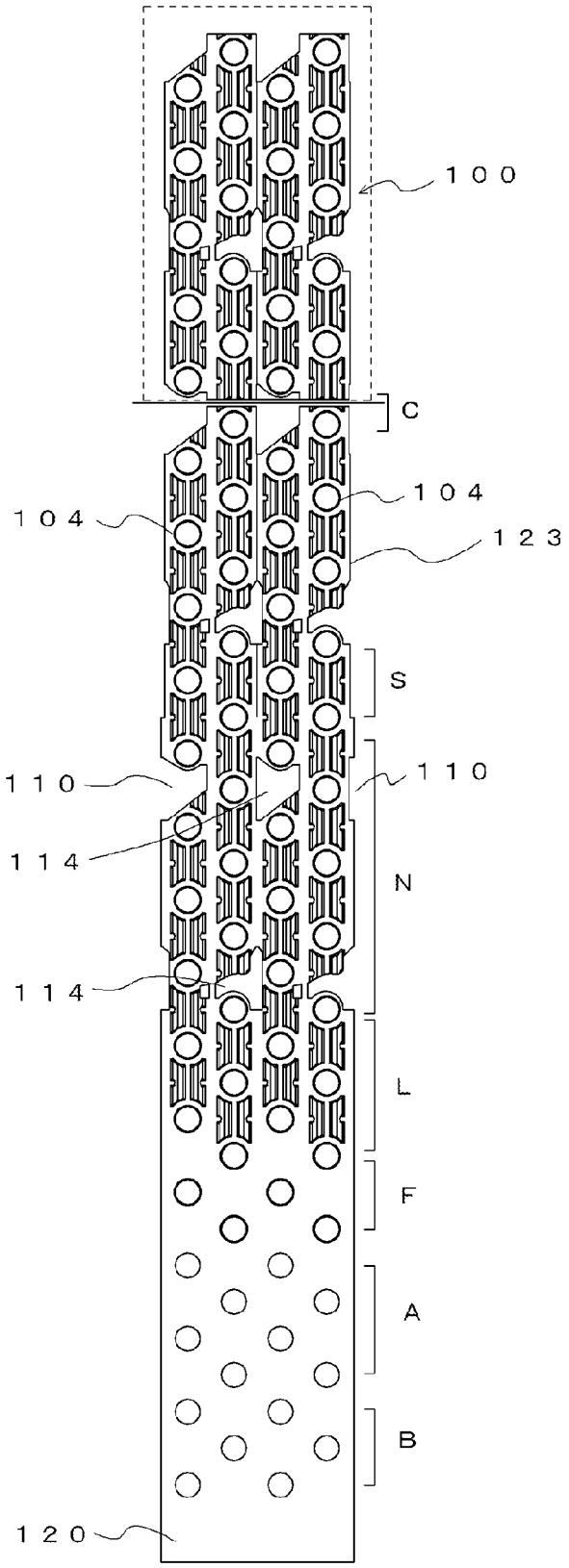
FIG.9 PRIOR ART
FIG. 9 is a diagram useful in explaining a method of manufacturing a heat exchanger fin depicted in FIG. 8.

The wide metal strip 120 depicted in FIG. 9 is supplied to the lower mold 10*a* depicted in FIG. 1 from the direction of the arrow Y. Formation stages for forming the collar-equipped through-holes 104, the louvers 112, the corner cut portions 110, and the punched-out portions 114 in the wide metal strip 120 are successively disposed in a region 12 on a supply entrance side for the wide metal strip 120. A cutter 14 that cuts the wide metal strip 120 in the length direction to produce the narrow metal strips 123 is provided on the exit side of the lower mold 10*a*. The cutter 14 has a plurality of cutter blades disposed at predetermined gaps in the width direction of the wide metal strip 120. The gaps between the cutter blades are equal to the width of the narrow metal strips 123.

A feeding-in apparatus 16 that feeds the wide metal strip 120 in which the collar-equipped through-holes 104, the louvers 112, the corner cut portions 110, and the punched-out portions 114 have been formed into the cutter 14 is provided on an entrance side of the cutter 14. In addition, a pulling-out apparatus 18 that pulls the narrow metal strips 123, which have been produced by the cutter 14 cutting the wide metal strip 120, out from the cutter 14 is provided on the exit side of the cutter 14.

In the feeding-in apparatus 16, a first reference plate 20 is provided on the entrance side of the cutter 14. The first reference plate 20 spans above fixed members 21*a*, 21*b* fixed at a predetermined gap on a lower mold base 11, and has a plurality of elongated holes 20*a*, 20*a*, . . . formed in the feeding direction of the wide metal strip 120.

Below the first reference plate 20, a first reciprocating body 22 is provided so as to be capable of moving reciprocally between the fixed members 21*a*, 21*b* fixed along the cutter 14. The first reciprocating body 22 moves along shafts 24, 24 that are perpendicular to the fixed members 21*a*, 21*b*.

In addition, in the pulling-out apparatus 18, a second reference plate 26 is provided on the exit side of the cutter 14. The second reference plate 26 spans above fixed members 27*a*, 27*b* fixed at a predetermined gap on the lower mold base 11 and has a plurality of elongated holes 26*a*, 26*a*, . . . formed in the feeding direction of the narrow metal strips 123.

Below the second reference plate 26, a second reciprocating body 28 is provided so as to be capable of moving reciprocally between the fixed members 27*a*, 27*b* fixed alongside the cutter 14. The second reciprocating body 28 moves along shafts 30, 30 that are perpendicular to the fixed members 27*a*, 27*b*.

The first reciprocating body 22 and the second reciprocating body 28 are coupled by a coupling plate 32 as a coupling member and both move in the same direction.

Figure 2:
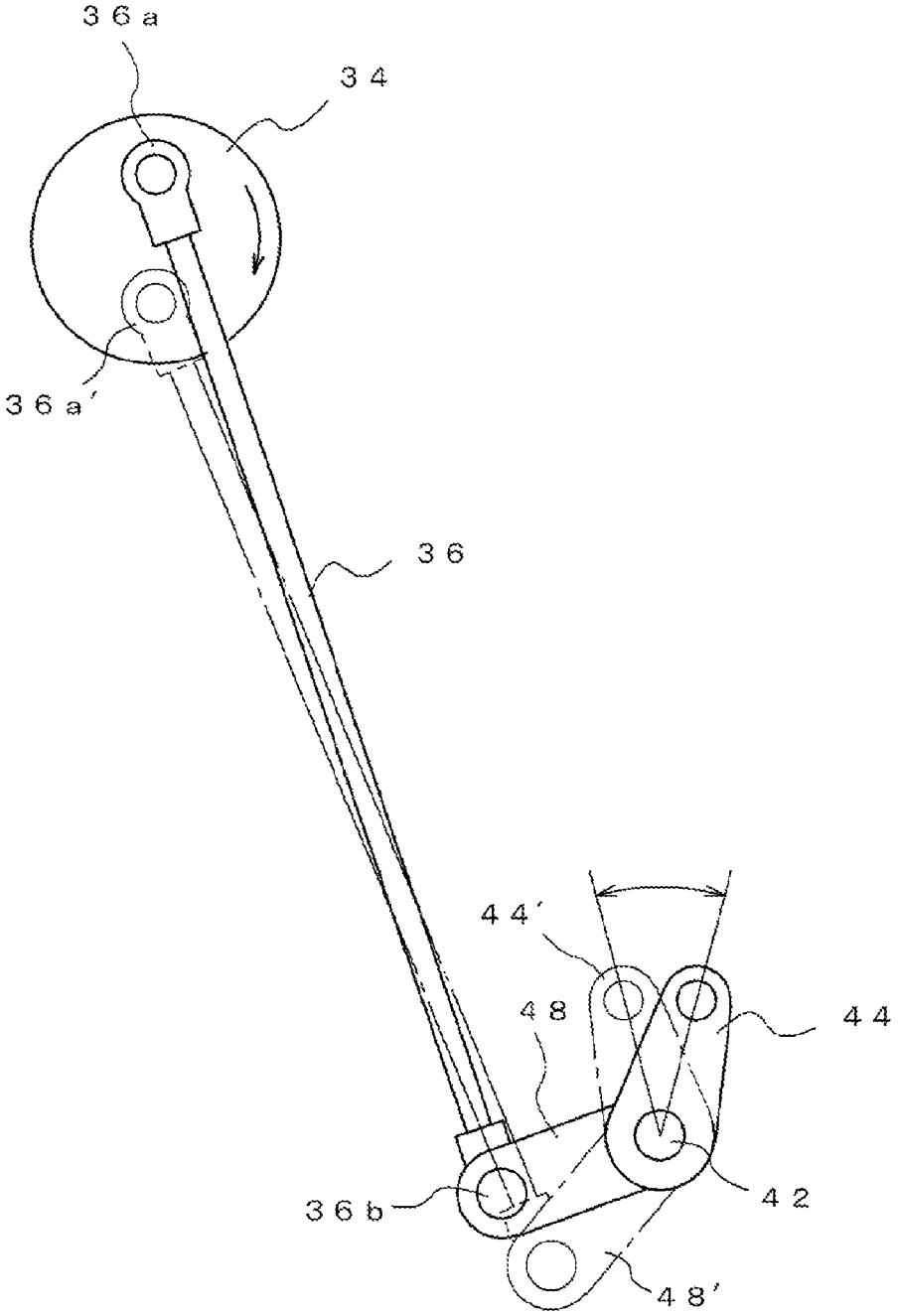
FIG. 2 is a diagram useful in explaining an overview of a driving apparatus that drives the first reciprocating body and the second reciprocating body depicted in FIG. 1.

The first reciprocating body 22 and the second reciprocating body 28 are driven by a driving apparatus depicted in FIG. 2. The driving apparatus includes a crank 34 that rotates in synchronization with the press apparatus 200, a coupling rod 36 with one end coupled to an eccentric pin 36*a* provided on the crank 34, a link 48 with one end coupled to a pin 36*b* coupled to the other end of the coupling rod 36, a pin 42 coupled to the other end of the link 48 and provided so as to be rotatable at a predetermined position, and a lever 44 with one end coupled to the pin 42.

With this driving apparatus, when the crank 34 rotates and the eccentric pin 36*a* reaches the 36*a*' position depicted in FIG. 2, the link 48 becomes positioned at the 48' position and the lever 44 rotates about the pin 42 to the 44' position.

Figure 3:
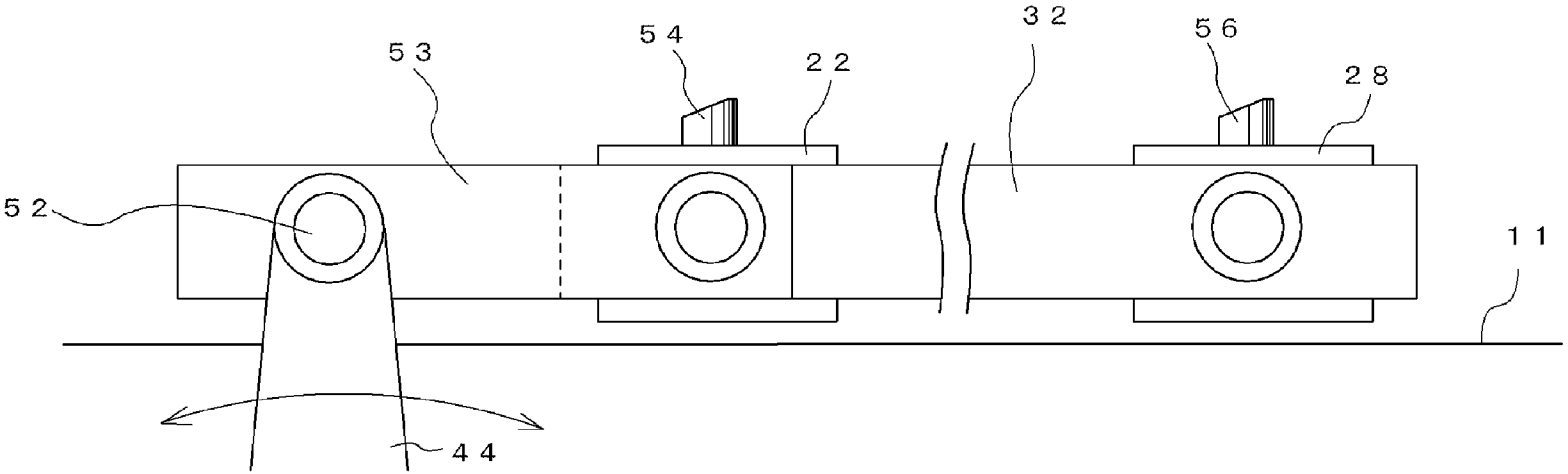
FIG. 3 is a side view of a first reciprocating body that constructs a feeding-in apparatus depicted in FIG. 1 and a second reciprocating body that constructs a pulling-out apparatus.

As depicted in FIG. 3, the upper end of the lever 44 is coupled to a coupling portion 52 of a plate member 53 coupled to the coupling plate 32, and the first reciprocating body 22 and the second reciprocating body 28 coupled by the coupling plate 32 are capable of moving reciprocally in the same direction.

Figure 4A:
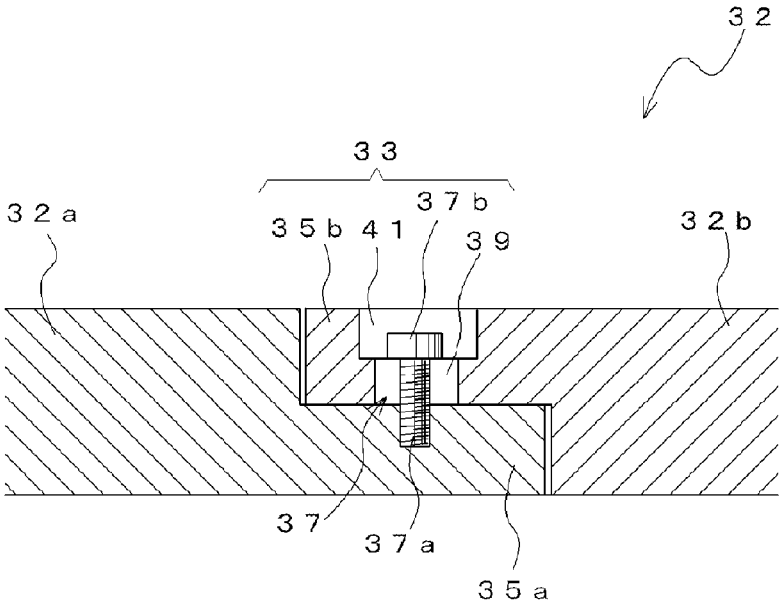
FIGS. 4A and 4B are diagrams useful in explaining one example of a length adjusting means for a coupling member that couples the first reciprocating body and the second reciprocating body.
Figure 4B:
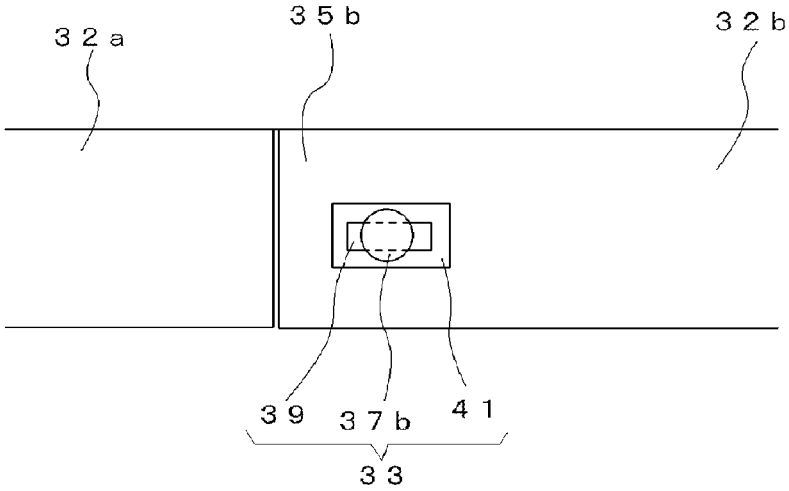

As depicted in FIGS. 4A and 4B, the coupling plate 32 has an adjustment portion 33 that adjusts the length of the coupling plate 32 provided at a center position of a first coupling portion 32*a* attached at one end to the first reciprocating body 22 and a second coupling portion 32*b* attached at one end to the second reciprocating body 28. FIG. 4A is a partial cross-sectional view useful in explaining the adjustment portion 33 and FIG. 4B is a partial plan view of the adjustment portion 33.

On the adjustment portion 33, an L-shaped front end portion 35*a* of the first coupling portion 32*a* and an L-shaped front end portion 35*b* of the second coupling portion 32*b* are slidably combined using a screw 37. A front end of a screw portion 37*a* of the screw 37 is screwed to the L-shaped front end portion 35*a* of the first coupling portion 32*a*. A first elongated hole 39 that is wider than the screw portion 37*a* and narrower than a brim portion 37*b* of the screw 37 is formed in the L-shaped front end portion 35*b* of the second coupling portion 32*b* through which the screw portion 37*a* is inserted, and a second elongated hole 41 that is wider than the brim portion 37*b* is formed above the first elongated hole 39.

With the adjustment portion 33, by loosening the attachment of the L-shaped front end portions 35*a*, 35*b* by the screw 37, it is possible to enable the screw 37 to move along the first elongated hole 39. This means that the L-shaped front end portions 35*a*, 35*b* slide and adjust the length of the coupling plate 32, which makes it possible to adjust the gap between the first reciprocating body 22 and the second reciprocating body 28.

In this way, by adjusting the gap between the first reciprocating body 22 and the second reciprocating body 28, it is possible to prevent the force applied to the narrow metal strips 123 cut by the cutter 14 from becoming excessive.

Also, as should be clear from FIG. 3, first pins 54 whose front end surfaces are formed as inclined surfaces are provided on the first reciprocating body 22 and second pins 56 whose front end surfaces are formed as inclined surfaces are provided on the second reciprocating body 28.

Since the first reciprocating body 22 on which the first pins 54 are provided and the second reciprocating body 28 on which the second pins 56 are provided have substantially the same construction, the construction of the first reciprocating body 22 will be described with reference to FIGS. 5A and 5B and description of the construction of the second reciprocating body 28 is omitted.

Figure 5A:
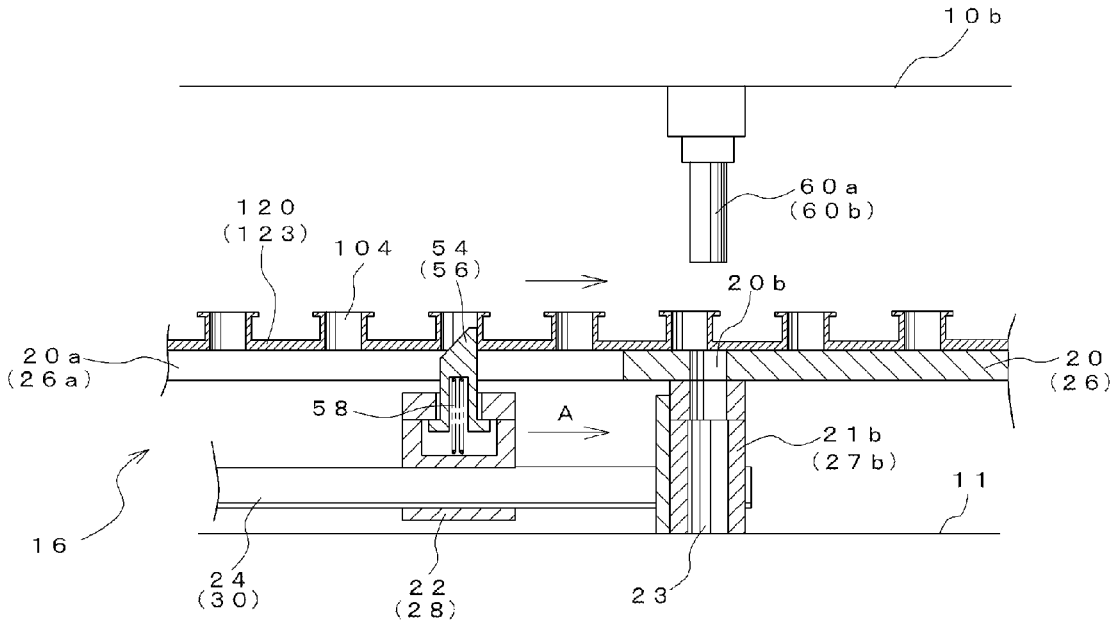
FIGS. 5A and 5B are diagrams useful in explaining the operation of the feeding-in apparatus depicted in FIG. 1 and one example of a stopper.
Figure 5B:
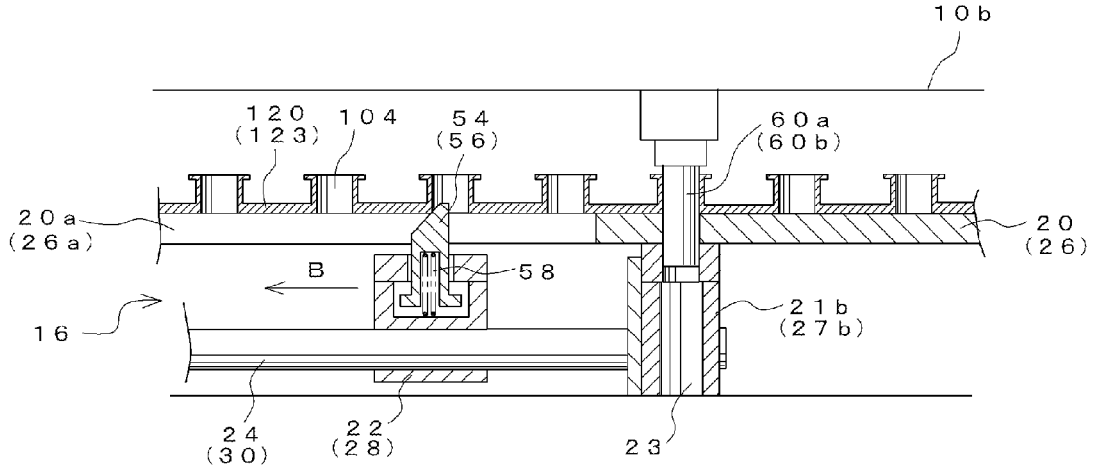

Note that in FIGS. 5A and 5B, the reference numerals of the component elements of the first reciprocating body 22 have been appended with the reference numerals of the corresponding component elements of the second reciprocating body 28.

Front end portions of the first pins 54 provided on the first reciprocating body 22 are energized by springs 58 as energizing members in the direction of the wide metal strip 120 that moves above the elongated holes 20*a* in the first reference plate 20. The front end surface of each first pin 54 is formed in an inclined surface that is inclined on the opposite side to the feeding direction of the wide metal strip 120.

For this reason, as depicted in FIG. 5A, when the first reciprocating body 22 moves the wide metal strip 120 in the direction of the cutter 14 (the direction of the arrow A), the front end portion of each first pin 54 provided on the first reciprocating body 22 is inserted from an elongated hole 20*a* of the first reference plate 20 inside a collar-equipped through-hole 104 of the wide metal strip 120 and feeds the wide metal strip 120 in the direction of the cutter 14.

On the other hand, as depicted in FIG. 5B, when the first reciprocating body 22 moves in a direction away from the cutter 14 (the direction of the arrow B), the front end portion of each first pin 54 provided on the first reciprocating body 22 becomes withdrawn from the collar-equipped through-hole 104 of the first reference plate 20 due to the inclined surface formed on the front end surface of the first pin 54. This means that the wide metal strip 120 is placed in a stopped state.

Accordingly, by moving reciprocally between the fixed members 21*a*, 21*b*, the first reciprocating body 22 is capable of feeding the wide metal strip 120 into the cutter 14.

At this time, even if the first pin 54 applies a feeding force that feeds the wide metal strip 120 depicted in FIG. 9, on which the corner cut portions 110 and the punched-out portions 114 have been formed during feeding, into the cutter 14, the wide metal strip 120 will still have sufficient durability. This means that the wide metal strip 120 depicted in FIG. 9 can be smoothly fed into the cutter 14.

In addition, it is also possible to pull the narrow metal strips 123, which are cut out by the cutter 14, out of the cutter 14 using the second pins 56 of the second reciprocating body 28 that moves reciprocally in concert with the first reciprocating body 22. For this second reciprocating body 28, it is sufficient to apply a pulling force that pulls the narrow metal strips 123 out from the cutter 14 to the narrow metal strips 123, and it is not necessary to apply a force to feed the wide metal strip 120 into the cutter 14, which means that it is possible to transport the narrow metal strips 123 in which cutaway portions 122 have been formed without tearing, kinking, or stretching.

Figure 10:
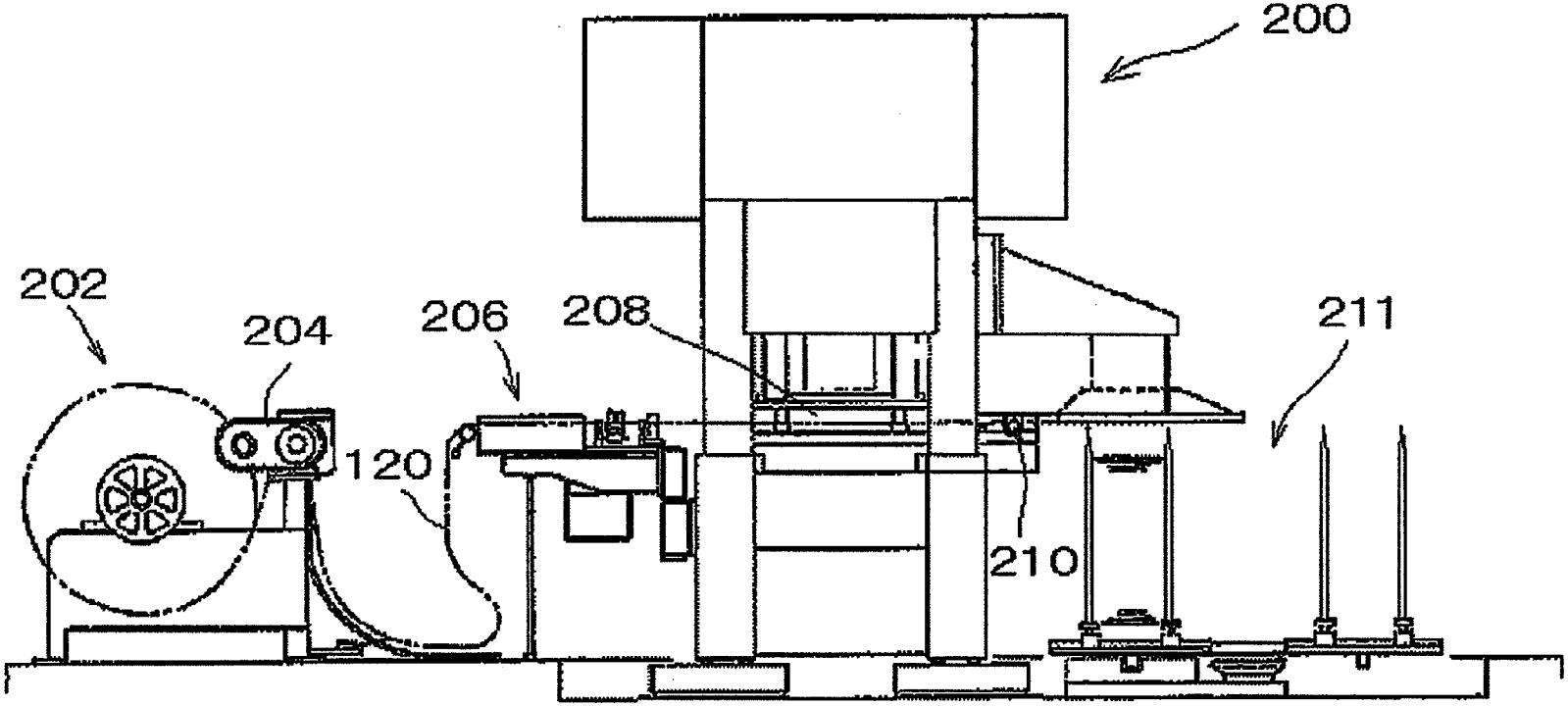
FIG.10 PRIOR ART
FIG. 10 is a schematic diagram of a manufacturing apparatus that manufactures the heat exchanger fin depicted in FIG. 8.
Figure 11:
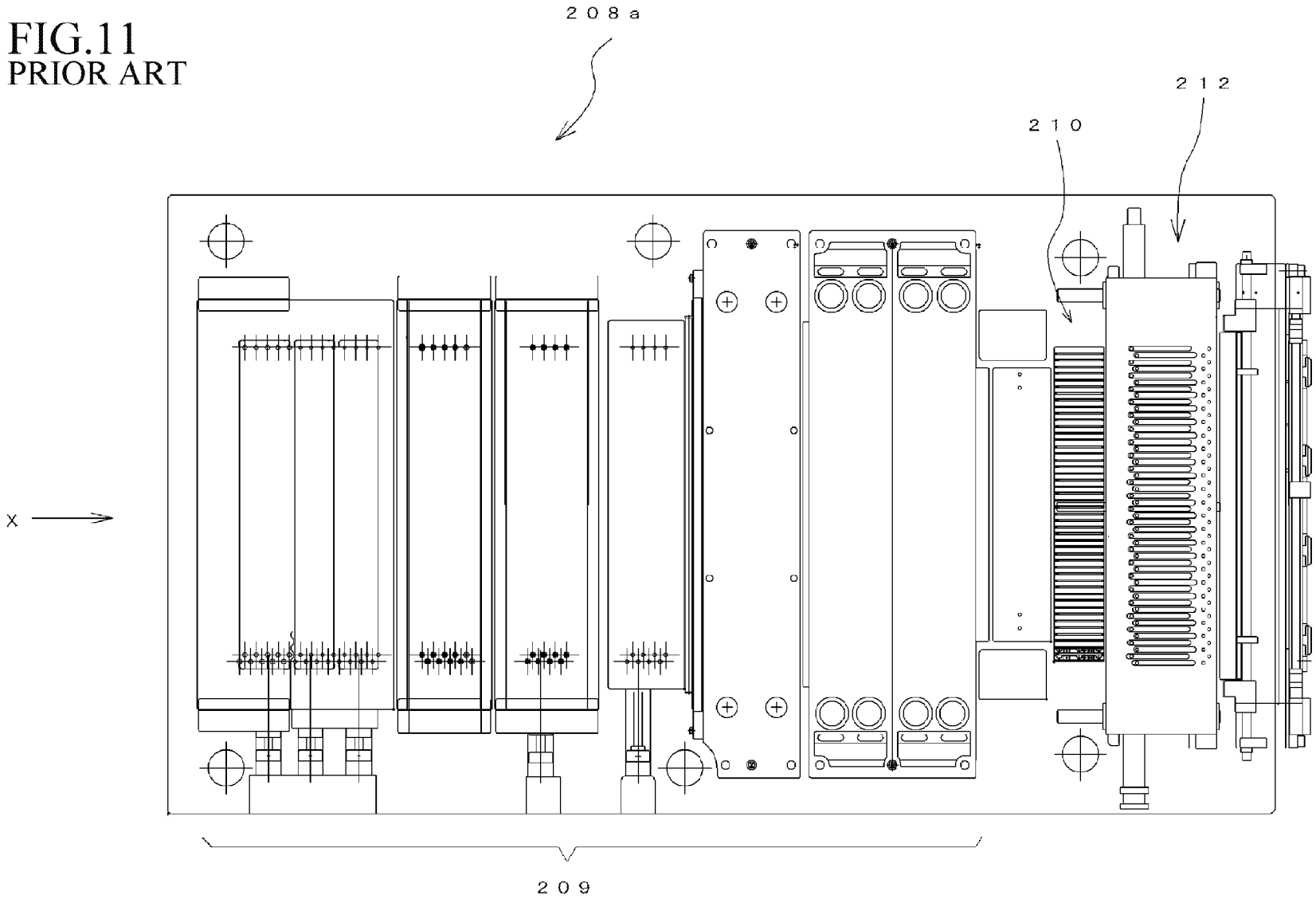
FIG.11 PRIOR ART
FIG. 11 is a plan view of a lower mold of the mold depicted in FIG. 10.

This means that with a manufacturing apparatus for heat exchanger fins where a mold incorporating the feeding-in apparatus 16 and the pulling-out apparatus 18 depicted in FIGS. 1 to 5B has been installed in the press apparatus 200 depicted in FIG. 10, it is possible to increase the operating speed of the press apparatus 200 and thereby increase production of the heat exchanger fin 100 depicted in FIG. 8.

In particular, by chamfering corner portions of the corner cut portions 110 and the punched-out portions 114 depicted in FIG. 9 into arc shapes (preferably arc shapes with a radius of 1 mm or higher), the tensile strength of the narrow metal strips 123 can be improved and it is possible to significantly further increase the operating speed of the press apparatus 200.

However, with the feeding-in apparatus 16 depicted in FIGS. 5A and 5B, as depicted in FIG. 5B, when the first reciprocating body 22 moves in a direction away from the cutter 14 (the direction of the arrow B), the front ends of the first pins 54 that have been withdrawn from the collar-equipped through-holes 104 of the wide metal strip 120 will move while rubbing the rear surface of the wide metal strip 120. This means that there is the risk that the wide metal strip 120 will move in the opposite direction to the feeding direction.

For this reason, it is preferable to provide a stopper that forcibly stops movement of the wide metal strip 120 when the first reciprocating body 22 moves in a direction away from the cutter 14 (in the direction of the arrow B).

An example of a stopper is depicted in FIGS. 5A and 5B. With the stopper depicted in FIGS. 5A and 5B, stopper pins 60*a* are provided on an upper mold 10*b* that moves toward and away from the lower mold 10*a*, through-holes 20*b* are provided in the first reference plate 20 of the lower mold 10*a*, and through-holes 23 are formed in the fixed member 21*b* fixed to the lower mold base 11.

In the feeding-in apparatus 16 depicted in FIGS. 5A and 5B, the first reciprocating body 22 moves so as to feed the wide metal strip 120 into the cutter 14 while the lower mold 10*a* and the upper mold 10*b* are open. This means that when the lower mold 10*a* and the upper mold 10*b* are closed, the feeding of the wide metal strip 120 is stopped and the first reciprocating body 22 moves in the direction away from the cutter 14 (in the direction of the arrow B). At this time, the front end portions of the stopper pins 60*a* are inserted through collar-equipped through-holes 104 of the wide metal strip 120 and also through the through-holes 20*b* of the first reference plate 20 and the through-holes 23 of the fixed member 21*b*.

Accordingly, it is possible to forcibly stop movement of the wide metal strip 120 in the opposite direction to the feeding direction due to the front ends of the first pins 54 moving in the direction away from the cutter 14 (in the direction of the arrow B) while rubbing the rear surface of the wide metal strip 120.

Figure 6A:
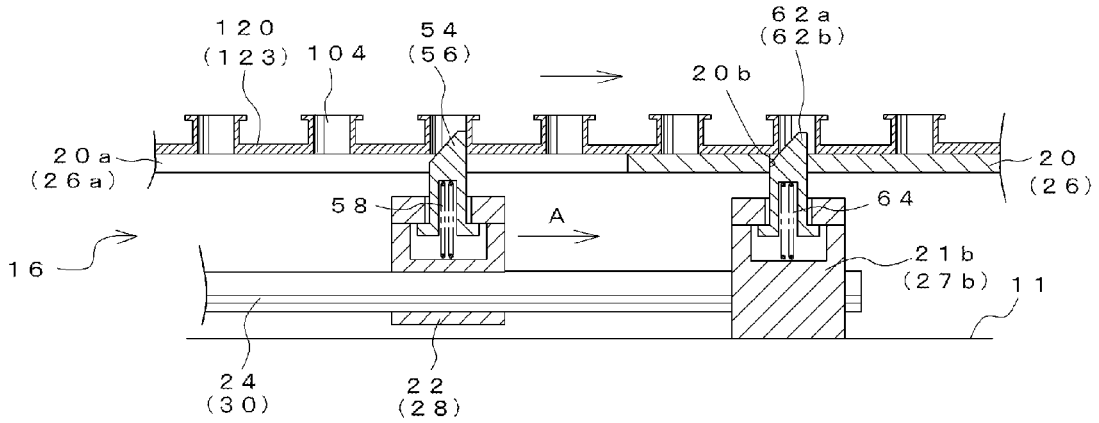
FIGS. 6A and 6B are diagrams useful in explaining the operation of another example of a stopper.
Figure 6B:
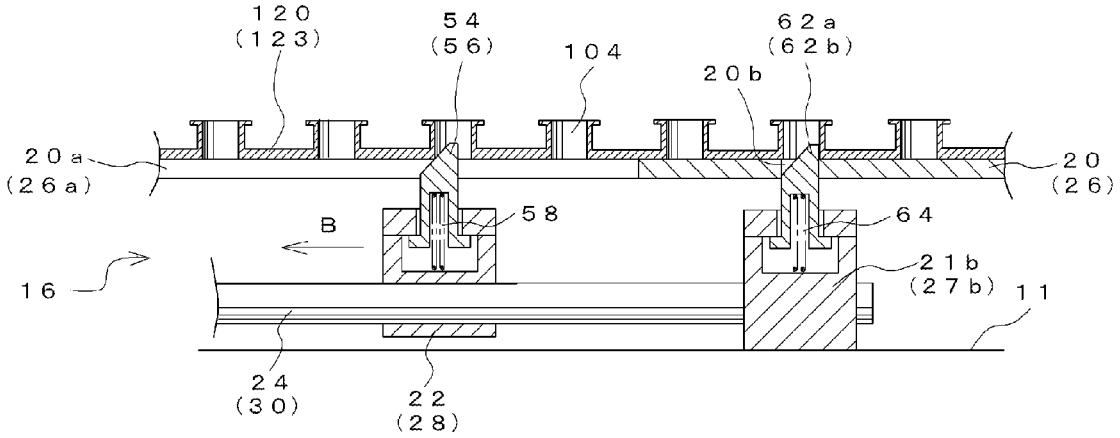

Also, as the stopper, it is possible to use the stopper depicted in FIGS. 6A and 6B. The stopper depicted in FIGS. 6A and 6B has stopper pins 62*a* with the same form as the first pins 54 provided on the fixed member 21*b* fixed to the lower mold base 11. Front end portions of the stopper pins 62*a* that have been inserted through the through-holes 20*b* formed in the first reference plate 20 are energized by springs 64 in the direction of the wide metal strip 120 that moves on the first reference plate 20.

As depicted in FIG. 6A, when the first reciprocating body 22 moves the wide metal strip 120 in the direction of the cutter 14 (in the direction of the arrow A), the stopper pins 62*a* become withdrawn from the collar-equipped through-holes 104 due to the inclined surfaces formed at the front end surfaces, so that the wide metal strip 120 is fed in the direction of the cutter 14 (in the direction of the arrow A).

On the other hand, as depicted in FIG. 6B, when the first reciprocating body 22 moves in the direction away from the cutter 14 (in the direction of the arrow B), the front end portions of the stopper pin 62*a* are inserted via the through-holes 20*b* in the first reference plate 20 into the collar-equipped through-holes 104 and prevent the wide metal strip 120 from moving.

Note that in FIGS. 6A and 6B, reference numerals of the component elements of the second reciprocating body 28 have been appended to the reference numerals of the component elements of the first reciprocating body 22.

The first pins 54 provided on the first reciprocating body 22 depicted in FIGS. 3 to 6B and the second pins 56 provided on the second reciprocating body 28 are energized in the direction of the wide metal strip 120 or the narrow metal strips 123 by the springs 58. Accordingly, the front end surfaces of the first pins 54 and the second pins 56 move so as to rub the rear surface of the wide metal strip 120 or the narrow metal strips 123 while the wide metal strip 120 and the narrow metal strips 123 are stopped. Such movement of the first pins 54 and the second pins 56 has the risk of damaging the rear surfaces and the louvers 112 of the wide metal strip 120 or the narrow metal strips 123.

Figure 7A:
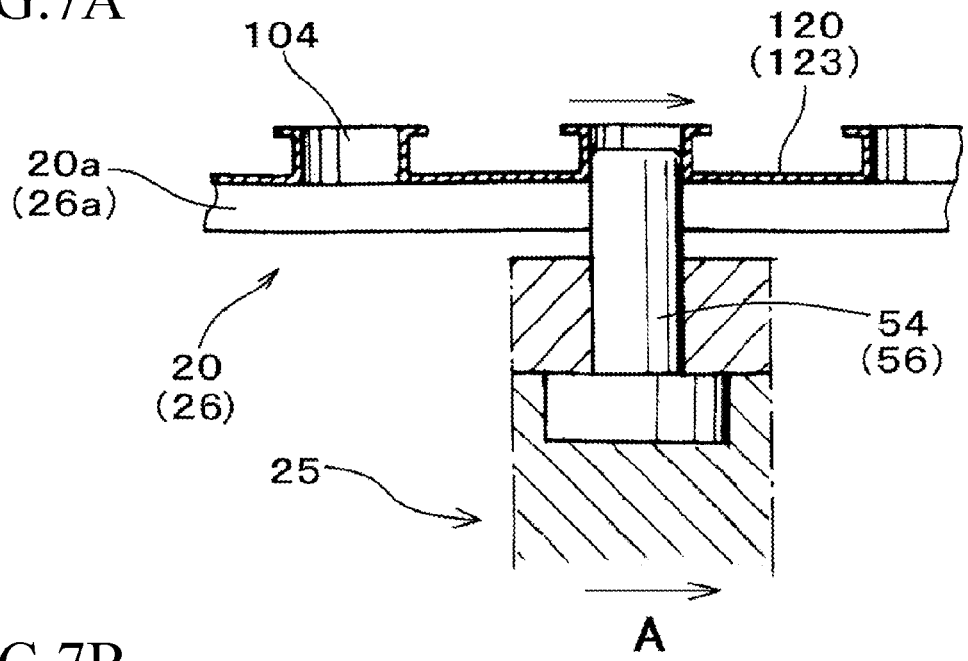
FIGS. 7A and 7B are diagrams useful in explaining the operation of another feeding-in apparatus.
Figure 7B:
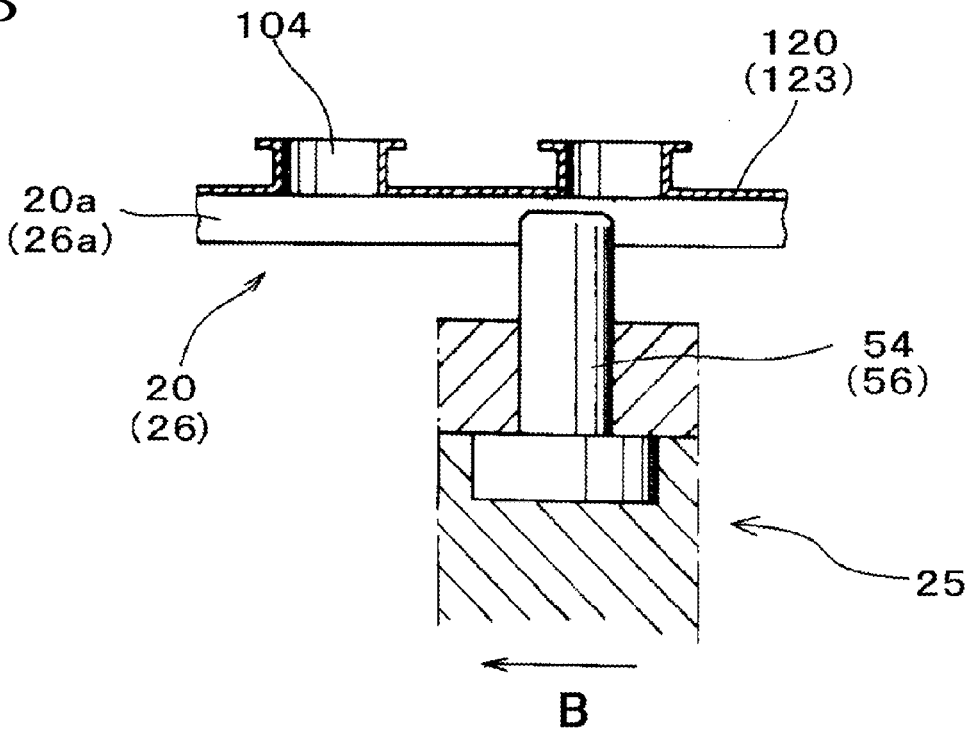

For the above reason, the first pins 54 and the second pins 56 depicted in FIGS. 7A and 7B are preferable. In FIGS. 7A and 7B, a first pin 54 provided on a pin block 25 that moves together with the first reciprocating body 22 is depicted. Again, reference numerals of corresponding component elements of the second reciprocating body 28 have been appended to the reference numerals of the component elements of the first reciprocating body 22.

With the first pins 54 depicted in FIGS. 7A and 7B, when the first reciprocating body 22 moves in the direction of the cutter 14 (in the direction of the arrow A) as depicted in FIG. 7A, the pin block 25 is pressed upward and the front end portions of the first pins 54 that are column-shaped are inserted from the elongated holes 20*a* in the first reference plate 20 into the collar-equipped through-holes 104 of the wide metal strip 120 so that the wide metal strip 120 is transported in the direction of the cutter 14.

On the other hand, when the first reciprocating body 22 moves in the direction away from the cutter 14 (in the direction of the arrow B) as depicted in FIG. 7B, the pin block 25 provided on the first reciprocating body 22 is pressed downward and the front end portions of the first pins 54 that are column-shaped are withdrawn from the collar-equipped through-holes 104 of the wide metal strip 120.

According to the first pins 54 depicted in FIGS. 7A and 7B, the risk of the front end surfaces of the first pins 54 rubbing the rear surface of the wide metal strip 120 and causing damage when the first pins 54 moves in a direction away from the cutter 1 can be eliminated.

To insert and withdraw the first pins 54 into and from the collar-equipped through-holes 104 of the wide metal strip 120 as depicted in FIGS. 7A and 7B, it is possible to provide an up-down moving member, such as a cam member, that moves the pin block 25 up and down on the first reciprocating body 22 (see, for example, Japanese Laid-Open Patent Publication No. 2006-21876).

Although the feeding apparatus for the metal strip described above is incorporated inside the mold and installed in the press apparatus 200, such feeding apparatus may be installed in a cutter provided outside the press apparatus.

It should also be obvious that the feeding apparatus for the metal strip described above can be used as a feeding apparatus for metal strips in which a plurality of through-holes are formed.

What is claimed is:

1. A feeding apparatus for metal strips that feeds a wide metal strip, in which a plurality of through-holes are formed with predetermined gaps in a length direction and a width direction, into a cutter and pulls narrow metal strips, which are formed by cutting the wide metal strip between the through-holes in the length direction out of the cutter, the wide metal strip being a wide metal strip that has punched-out portions formed between the through-holes, and the narrow metal strips being narrow metal strips where corner cut portions, where side edges are cut away, are formed, the feeding apparatus comprising:

a feeding-in apparatus that is provided on an entrance side of the cutter and feeds the wide metal strip, in which the punched-out portions are formed between the through-holes, into the cutter; and a pulling-out apparatus that is provided on an exit side of the cutter and pulls out the narrow metal strips, which have been cut out by the cutter and in which the corner cut portions, where the side edges are cut away, are formed, from the cutter, wherein the feeding-in apparatus includes:

a first reciprocating body provided so as to be capable of moving reciprocally with respect to the cutter; and first pins provided on the first reciprocating body and capable of moving up and down so that front end portions thereof are inserted into and withdrawn from the through-holes of the wide metal strip, the front end portions being inserted into the through-holes of the wide metal strip when the wide metal strip is fed into the cutter, wherein the pulling-out apparatus includes:

a second reciprocating body provided so as to be capable of moving reciprocally with respect to the cutter; and second pins provided on the second reciprocating body and capable of moving up and down so that front end portions thereof are capable of being inserted into and withdrawn from through-holes of the narrow metal strips, the front end portions being inserted into the through-holes of the narrow metal strips when the narrow metal strips are pulled out of the cutter, and wherein the feeding apparatus further comprises:

a driving apparatus that drives the first reciprocating body and the second reciprocating body in a predetermined direction; and a linking member that causes the first reciprocating body and the second reciprocating body to move in concert so that the wide metal strip is fed into the cutter with the narrow metal strips being pulled out from the cutter.

2. A feeding apparatus for metal strips according to claim 1, wherein the linking member includes:

a coupling member that couples the first reciprocating body and the second reciprocating body; and an adjusting portion that adjusts the length of the coupling member.

3. A feeding apparatus for metal strips according to claim 1, wherein the feeding-in apparatus includes a first stopper operable when the first pins move in an opposite direction to a feeding direction of the wide metal strip, to become inserted into one of the through-holes of the wide metal strip to prevent movement in the opposite direction to the feeding direction of the wide metal strip and also operable when the first pins move in the feeding direction of the wide metal strip, to become withdrawn from the through-hole of the wide metal strip to enable the wide metal strip to move in the feeding direction.

4. A feeding apparatus for metal strips according to claim 1, wherein the pulling-out apparatus includes a second stopper operable when the second pins move in an opposite direction to a feeding direction of the narrow metal strips, to become inserted into one of the through-holes of the narrow metal strip so as to prevent movement in the opposite direction to the feeding direction of the narrow metal strips and also operable, when the second pins move in the feeding direction of the narrow metal strip, to become withdrawn from the through-holes of the narrow metal strips so as to enable the narrow metal strips to move in the feeding direction.

5. A feeding apparatus for metal strips according to claim 1, wherein the cutter, the feeding-in apparatus, the pulling-out apparatus, and the linking member are provided inside a mold that forms the through-holes in the wide metal strip.

6. A feeding apparatus for metal strips according to claim 1, wherein corner portions of the punched-out portions and corner cut portions are chamfered into arc shapes.

* * * * *